US012618246B2

(12) United States Patent
Will et al.

(10) Patent No.: US 12,618,246 B2
(45) Date of Patent: May 5, 2026

(54) EXTERIOR TRIM SYSTEM

(71) Applicant: Freedom Metals Manufacturing, Inc., Duncansville, PA (US)

(72) Inventors: Matthew J. Will, Duncansville, PA (US); Lawrence Preston Karstetter, Jr., Roaring Spring, PA (US)

(73) Assignee: Freedom Metals Manufacturing, Inc., Duncansville, PA (US)

( * ) Notice: Subject to any disclaimer, the term of this patent is extended or adjusted under 35 U.S.C. 154(b) by 303 days.

(21) Appl. No.: 18/188,924

(22) Filed: Mar. 23, 2023

(65) Prior Publication Data

US 2023/0304305 A1 Sep. 28, 2023

Related U.S. Application Data

(60) Provisional application No. 63/323,353, filed on Mar. 24, 2022.

(51) Int. Cl.
*E04F 19/06* (2006.01)

(52) U.S. Cl.
CPC ..... *E04F 19/061* (2013.01)

(58) Field of Classification Search
CPC ..... E04F 19/061; E04F 19/062; E04F 19/022
See application file for complete search history.

(56) References Cited

U.S. PATENT DOCUMENTS

| | | | | |
|---|---|---|---|---|
| 8,079,186 | B2 | 12/2011 | Williams | |
| 8,495,844 | B1 | 7/2013 | Johnson | |
| 10,900,243 | B2 | 1/2021 | Koethe | |
| 2020/0370311 | A1 * | 11/2020 | Koethe | E04F 19/061 |

FOREIGN PATENT DOCUMENTS

| | | | | |
|---|---|---|---|---|
| CN | 214302701 | | 9/2021 | |
| DE | 102010022111 | A1 * | 11/2011 | E04D 11/00 |
| JP | 10046784 | | 2/1998 | |
| JP | 2752427 | | 5/1998 | |

OTHER PUBLICATIONS

International Search Report for corresponding International Application No. PCT/US2023/064861 dated Jul. 27, 2023.

* cited by examiner

*Primary Examiner* — Patrick J Maestri
(74) *Attorney, Agent, or Firm* — Reed Smith LLP; Matthew P. Frederick; Cheryl L. Gastineau

(57) ABSTRACT

Trim system devices and methods for building surfaces, such as exterior surfaces with building panels. In embodiments, a top trim panel is snap fit onto a base trim panel after the building panel has been installed. The trim system readily assembles and overhangs relatively rigid building panels without tools or precision cuts. In some embodiments, the trim system may be mounted at a building corner.

8 Claims, 10 Drawing Sheets

EXTERIOR TRIM SYSTEM

CROSS-REFERENCE RELATED APPLICATIONS

This application claims the benefit under 35 U.S.C. § 119(e) of the earlier filing date of U.S. Provisional Patent Application No. 63/323,353 filed on Mar. 24, 2022, the disclosure of which is incorporated by reference herein.

FIELD

This disclosure is directed to cladding, panels, siding and trim systems for building exteriors.

BACKGROUND

A building exterior is cladded with panels such as siding for purposes such as weather protection, insulation, and aesthetics. Trim is installed where the panels end, such as at the ends of a building surface or at features such as doors and windows. Trim installation is often more time-consuming and imprecise than most panels, resulting in higher costs.

BRIEF SUMMARY OF THE DISCLOSURE

Disclosed herein are trim systems and components thereof. The system components may include a base trim panel. A base trim panel may have a base portion configured to be mounted to a building exterior. A base trim panel may have a receiver portion extending away from the building exterior, e.g., from a base trim panel. The system components may also include a top trim panel. A top trim panel may include an overhang portion. A top trim panel may also include a retention portion, wherein the overhang portion is configured to overhang an edge of a building panel mounted on the building exterior, e.g., adjacent to a base portion of a base trim panel. In preferred embodiments, a receiver portion and a retention portion cooperate to provide connection between the base trim panel and the top trim panel. In various embodiments a receiver portion and a retention portion cooperate to form a snap-fit. In various embodiments a receiver portion and a retention portion cooperate to form an interference fit.

BRIEF DESCRIPTION OF THE DRAWINGS

Various embodiments can be completely understood in consideration of the following detailed description of various embodiments of the invention in connection with the accompanying drawings, in which.

Figure 1:
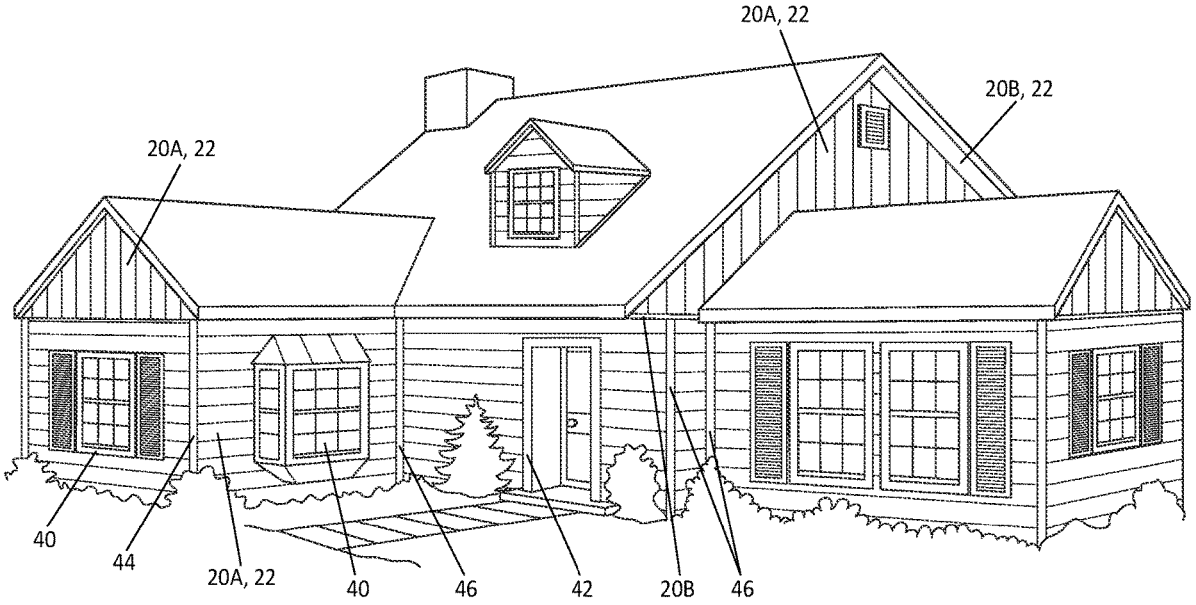
FIG. 1 is a perspective view of a building including a building panel in accord with various embodiments of the present disclosure.

While the invention is amenable to various modifications and alternative forms, specifics thereof have been depicted by way of example in the drawings and will be described in detail. It should be understood, however, that the intention is not to limit the invention to the particular embodiments described. On the contrary, the intention is to cover all modifications, equivalents, and alternatives falling within the spirit and scope of this disclosure, including as it is defined by the appended claims.

DETAILED DESCRIPTION

Modern paints for steel siding address an old problem called oil canning. When steel siding is marked or warped or dented in any way it creates large unsightly effects. With new paints this problem is solved, which now makes steel siding and ceiling dressing a desirable and attractive option in residential settings. Specifically, textured paints obscure or eliminate oil canning effects visible in steel siding.

However, steel siding is very rigid and inflexible. When you have two opposing edges (which occurs on every wall, or between windows, or between a window and a roof) it is desirable to provide a trim system to cover the edges of the building panels to provide a finished appearance and or protect the edges of the building panel from the elements. Edges are typically trimmed with J-channel. J-Channel in aluminum siding or in plastic siding has some give, as do the siding panels, but this is less so in steel siding. Typically, when working a piece of siding into two opposing J-channels, one flexes either the J-channel or the siding. This is not effective when installing steel siding.

Also, typically a wall is painted after it is mounted, that is, when the siding is disposed into the J-channels. It is difficult to paint the inside of a J-channel, so often when standing close to a wall you can see unsightly unpainted surfaces inside the J-channel.

This disclosure provides trim systems that replace a traditional J-channel for trimming the edges of building panels, wherein the trim systems comprise a base trim panel and a snap-on top trim panel. In this solution, one lays down a base trim panel on a building exterior, mounts a siding panel on the building exterior adjacent to or overlaying the base trim-panel, paints, and applies a snap-on top trim piece to the base trim panel to cover the edge of the building panel. The trim system and building panels described herein can be installed with minimal flexing and with simple paint application.

As used herein, the terms "substantially parallel to", "substantially orthogonal to", substantially perpendicular to" and similar terms mean that at least a portion of a component is parallel to, orthogonal to, or perpendicular to another component with a variance less than 10 degrees, or less than 5 degrees. The terms "adjacent to" and "substantially adjacent to" means that at least a portion of a component is next to, but not necessarily in contact with another component, with no intervening structure. The term "proximate to" means at least a portion of a component is close to or near another component. The term "L-shaped" means that a component or structure comprises two portions that are substantially perpendicular to each other so that a cross-section of the component resembles a capital L. The term "C-shaped" means that a component or structure comprises a central portion and two side portions that are each substantially perpendicular to the central portion, directed toward the same direction from the central portion and substantially parallel to each other so that a cross-section of the component resembles a block capital C.

Figure 2:
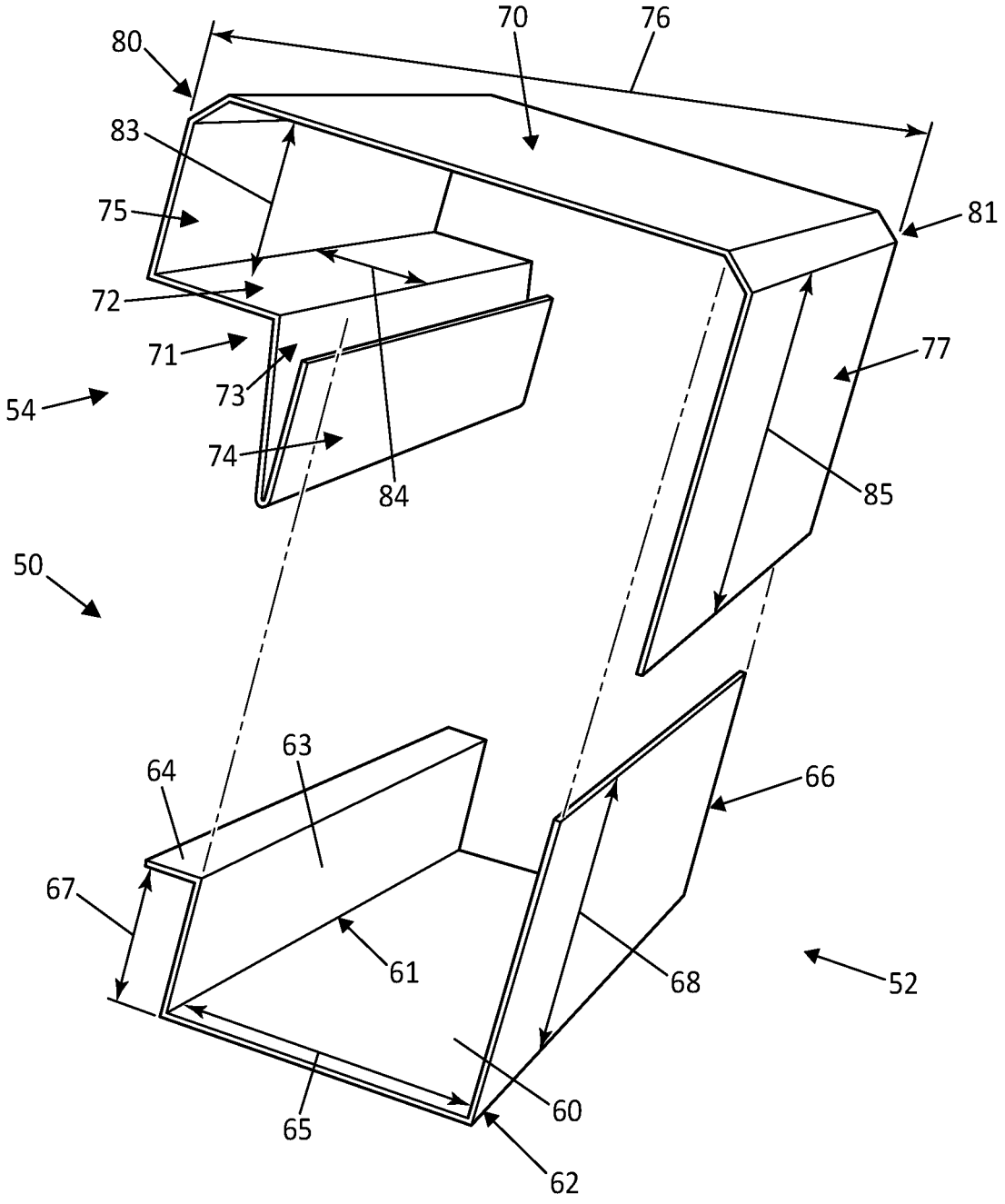
FIG. 2 is an exploded perspective view of a trim system in accord with various embodiments of the present disclosure.
Figure 3:
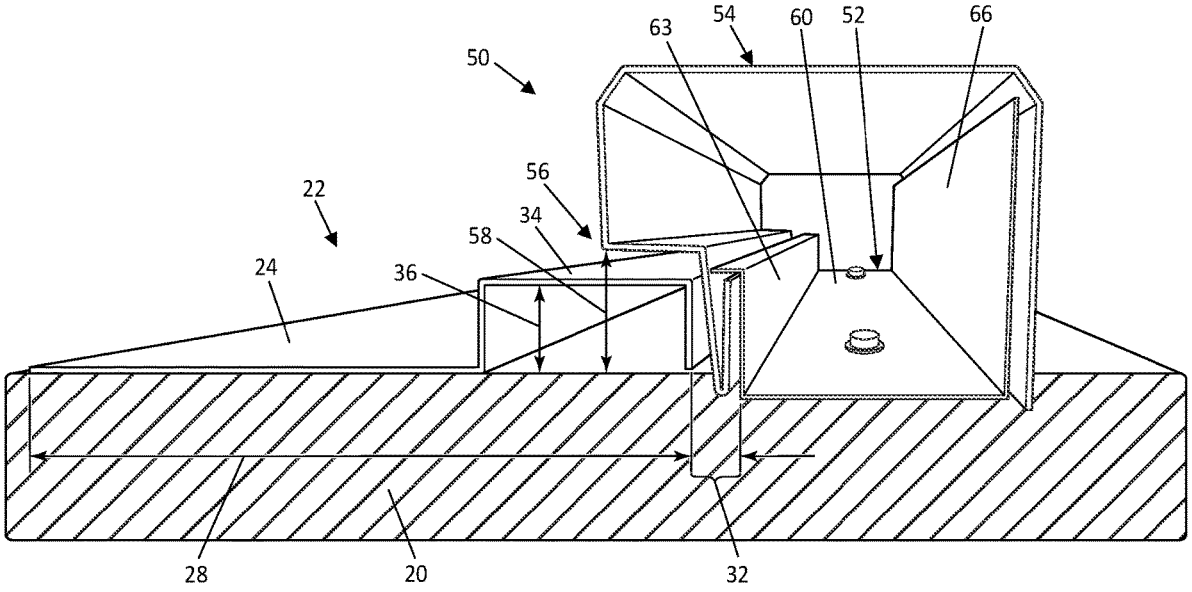
FIG. 3 is a top end view of various embodiments of a trim system in accordance with FIG. 2 assembled on a portion of a building.
Figure 4:
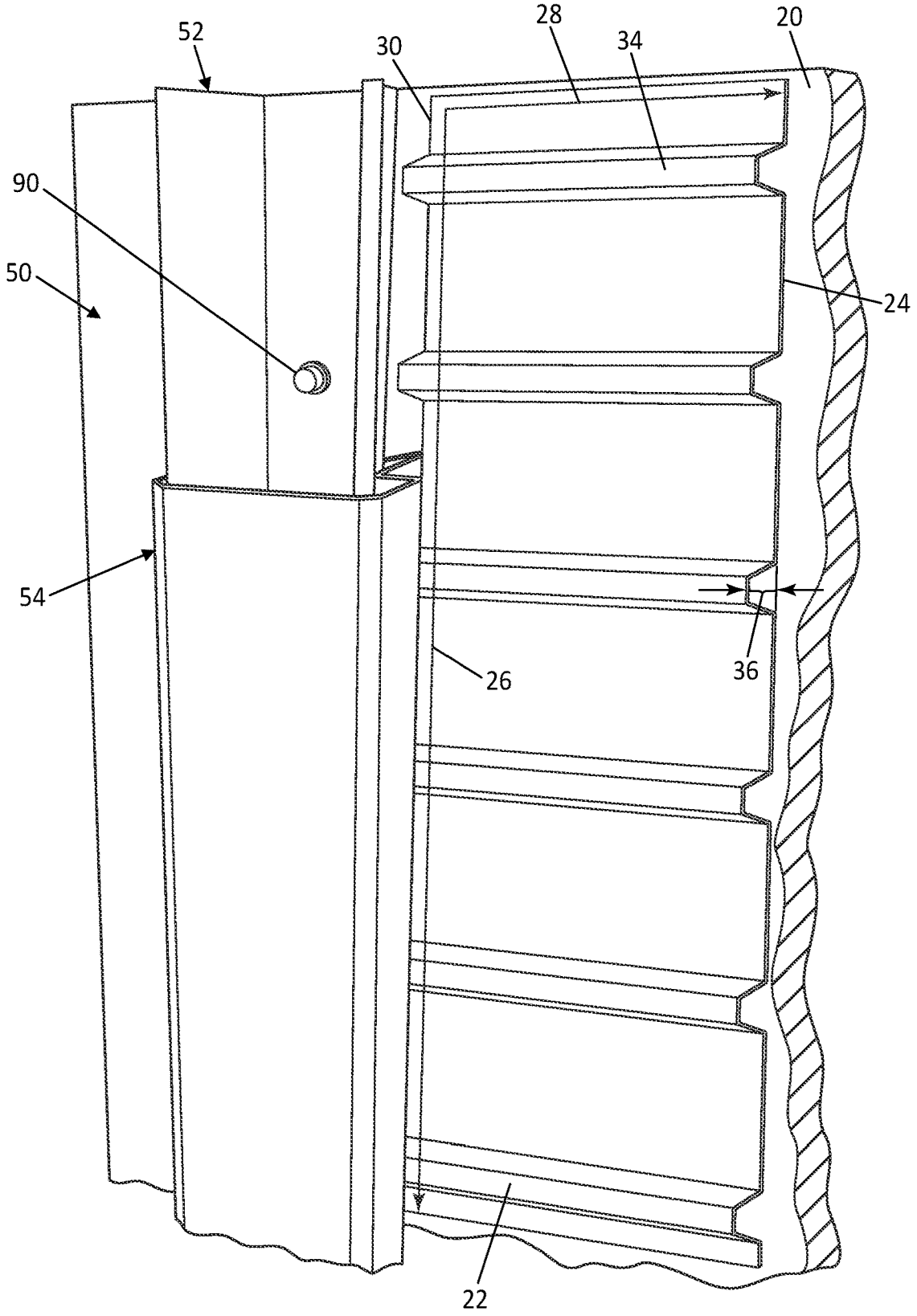
FIG. 4 is a partial front perspective view of various embodiments of a trim system in accordance with FIG. 2 assembled on a portion of a building.
Figure 5:
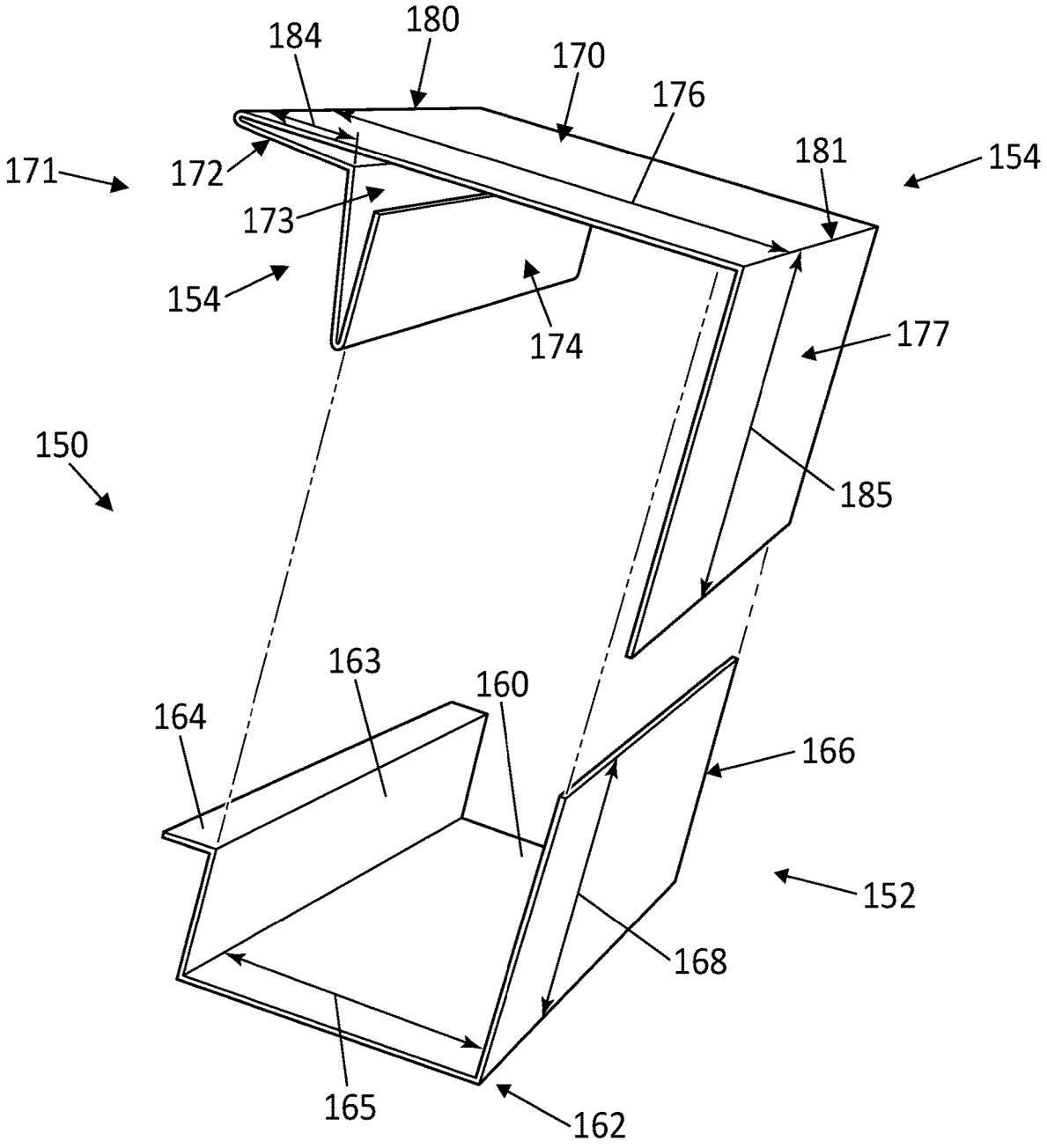
FIG. 5 is an exploded perspective view of a trim system in accord with various other embodiments in accordance with the present disclosure.
Figure 6:
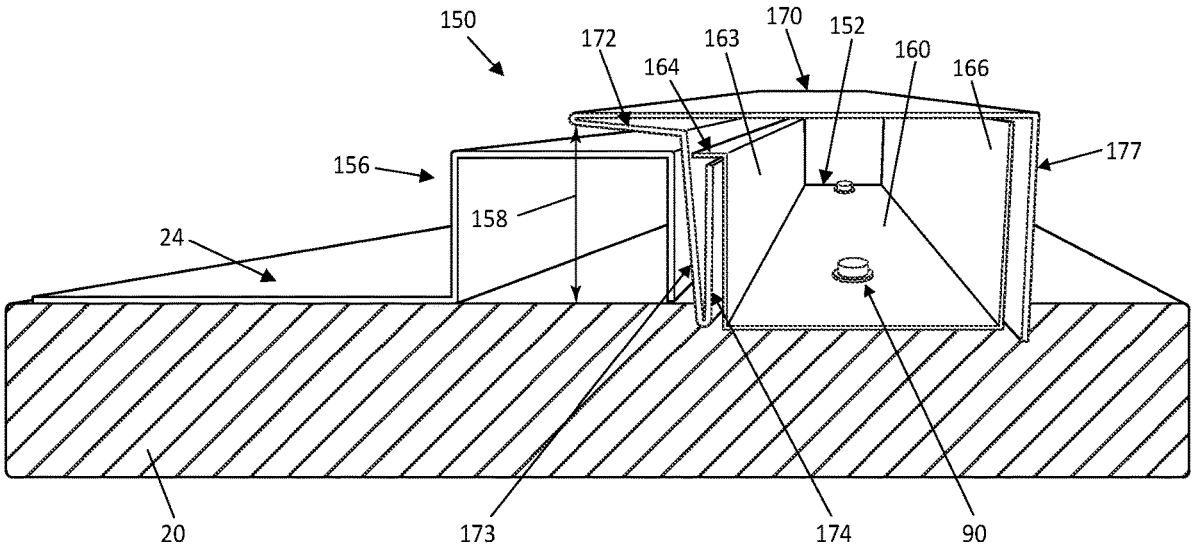
FIG. 6 is a top end view of various embodiments of a trim system in accordance with FIG. 5 assembled on a portion of a building.
Figure 7:
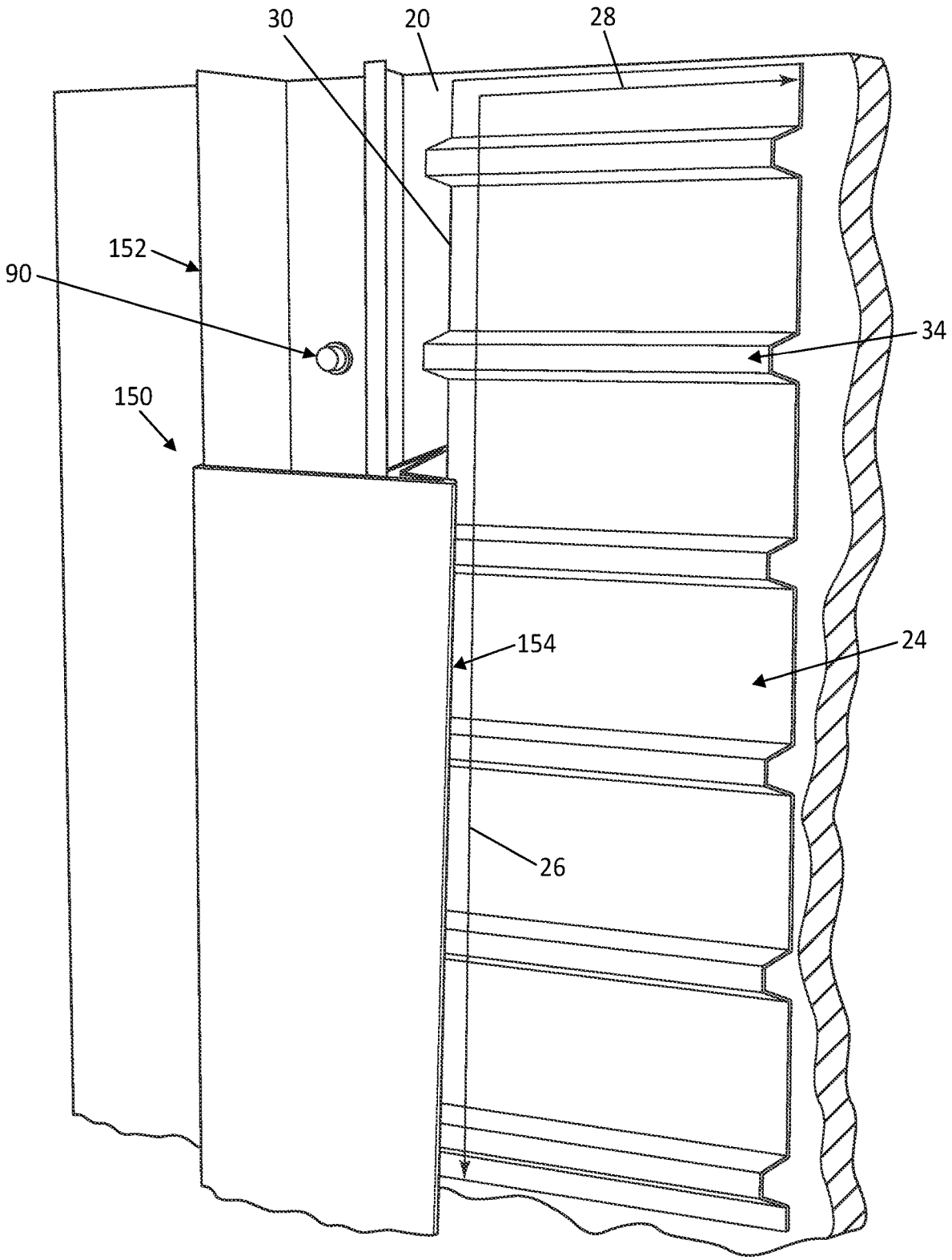
FIG. 7 is a partial front perspective view of various embodiments of a trim system in accordance with FIG. 5 assembled on a portion of a building.
Figure 8:
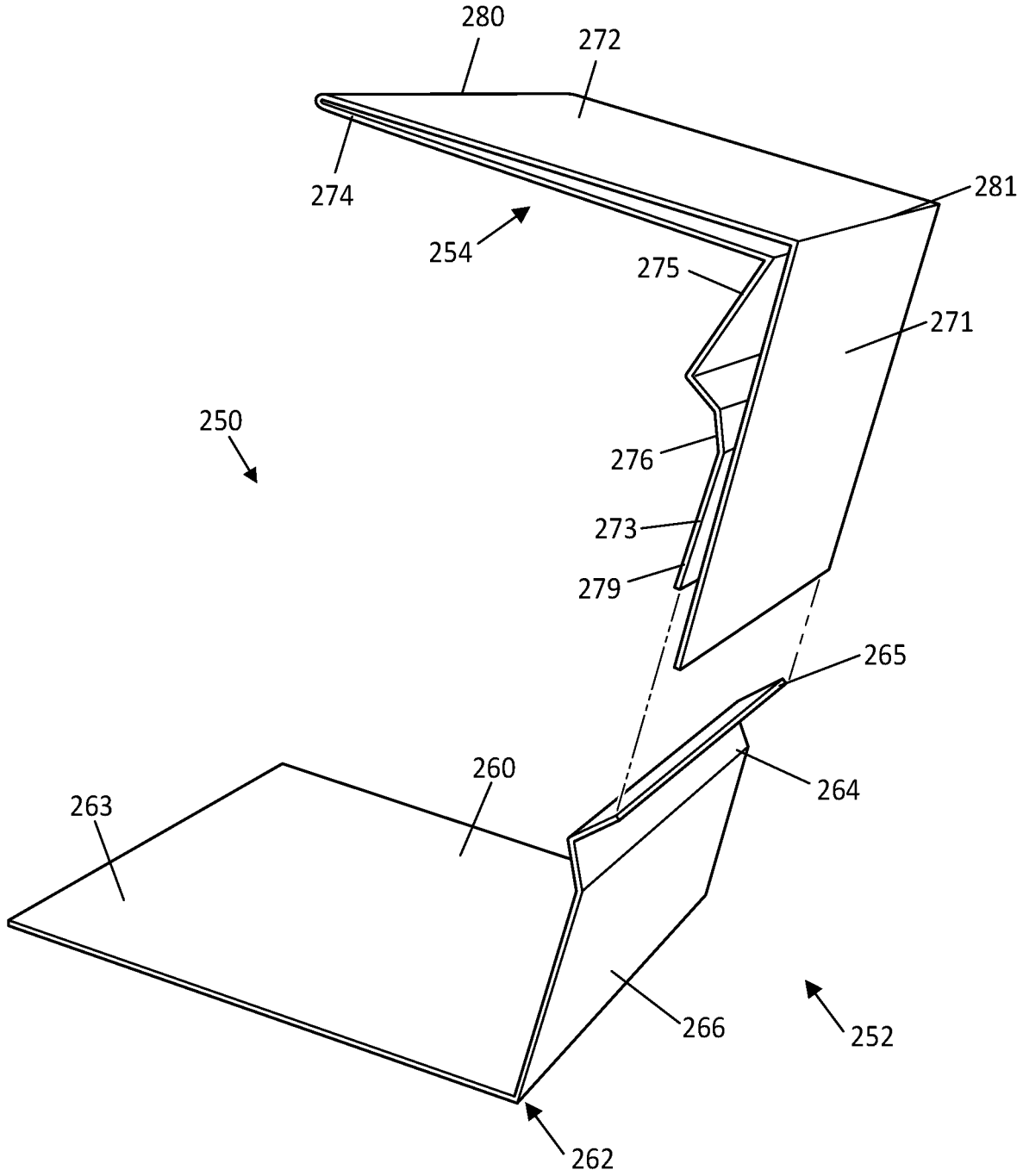
FIG. 8 is an exploded perspective view of a trim system in accord with various other embodiment in accordance with the present disclosure.

Referring generally to FIGS. 1-10 and applicable to any embodiments of the present disclosure, a building surface 20 is cladded with a panel system 22 and a trim system 50, 150, 250 (e.g., as shown in FIGS. 3, 5, and 8), both of the panel system and trim system being affixed to the building surface as shown in FIG. 1. In embodiments, the building surface 20 is an exterior surface such as a wall or ceiling and the panel system 22 and trim system 50, 150, 250 provides a degree of weatherproofing protection. In various embodiments, the building surface 20 may be vertical, horizontal, angled, or curved and the panel system 22 and the trim system 50, 150, 250 may be correspondingly sized, oriented, and/or curved without departing from the scope of the present disclosure. Referring to FIG. 1, applicable paneled building surfaces for the panel system 22 may include vertical walls 20A that are vertical or angled and ceilings 20B that are horizontal or angled, although other surfaces and buildings are contemplated. Applicable areas of the building for the trim system 50, 150, 250 may include windows 40, doorways 42, exterior corners 44, and interior corners 46, although other locations and buildings are contemplated. In various embodiments, a panel system 22 and a trim system 50, 150, 250 are formed of a metal (e.g., steel, copper, aluminum or alloys) or non-metallic (e.g., vinyl, fiber cement board, composites), but in certain preferred embodiments a panel system 22 and a trim system 50, 150, 250 are formed of steel (or a similarly rigid metal) such that components have a rigidity that makes manual temporary adjustments of the shape of such a panel system 22 or such a trim system 50, 150, 250 during installation difficult or impossible, and which if not covered with a proper paint (e.g., a textured paint) will exhibit unsightly oil canning effects. One will appreciate that in such embodiments, ancillary non-metal or less rigid components (e.g., glues, adhesive, caulking, fasteners, tools, tapes, etc.) may be used in the attaching of components to a wall panel, for example, without departing from a system formed of steel (or a similarly rigid metal).

A panel system 22 provides one or more building panels 24, generally described herein without limitation as a building panel or wall panel, having a length 26 and width 28 (e.g., as shown in FIG. 4). For ease of presentation, the building exterior, trim system and building panels 24 are illustrated in a truncated manner in FIGS. 2-10, so that the full length and width of the building panels and length of the trim panels are not shown. The length 26 and width 28 may be substantially consistent or, in some embodiments, one or both of the length and width is variable. In embodiments shown in FIGS. 3-4, a wall panel 24 comprises one or more ribs 34 defining a height 36. Ribs 34 may take various forms including horizontal, vertical, multiple ribs per panel, or a single rib per panel. Ribs, e.g., 34, may alternatively extend vertically or horizontally or in any desired direction. In various embodiments, a panel 24 may be formed with grooves and/or textures to simulate other building surfaces such as shingles, clapboards, brick, stone, etc. In other embodiments, a panel 24 may be substantially flat and unadorned. In some embodiments, such as for application as, or including, a soffit, panel 24 may have perforations to allow air to pass through to ventilate parts of the building such as attic spaces.

The panel system 22 may comprise materials that are substantially rigid, that is, rigid enough that the individual wall panel 24 cannot be readily bent manually or by hand tools. This substantially rigid composition limits or hinders an installer's ability to manipulate the wall panel 24 to fit with trim, resulting in more time-consuming and costly installation methods. For example, a wall panel 24 may be made of sheet metal such as steel, copper or various alloys. In other embodiments, a panel may comprise fiber cement or other rigid composite materials. In some preferred embodiments, a wall panel 24 may be folded steel sheet metal having one or more ribs, e.g., 34, in which case such folds impart greater rigidity making manual manipulation more difficult.

An exemplary panel system 22 comprises a wall panel 24 that, when assembled, is positioned adjacent to or overlaying one or more elements of a trim system 50, 150, 250. The width 28 of the wall panel 24 extends toward such a trim system 50, 150, 250. In embodiments, a gap 32 is defined between edge 30 of a wall panel 24 and a base trim panel 52, 152, 252 of a trim system 50, 150, 250. A trim system 50, 150, 250 is configured to at least partially overlap the width 28 of a wall panel 24 near its edge 30, resulting in consistent appearance and protection for cladding the building regardless of variations in the gap 32.

Referring to FIGS. 2-10, an exemplary trim system 50, 150, 250 comprises a base trim panel 52, 152, 252 and a top trim panel 54, 154, 254. In embodiments, a top trim panel 54, 154, 254 is configured to snap onto a base trim panel 52, 152, 252 for assembly; in other words, the top trim panel positively attaches to the base trim panel without tools or fasteners by at least partially overlapping the base trim panel and one or both of the trim panels moving resiliently against the other. In embodiments, an interference fit between members of a base trim panel 52, 152, 252 and a top trim panel 54, 154, 254 thereby a top trim panel 54, 154, 254 to a retaining a base trim panel 52, 152, 252 and thereby to a surface of the wall being trimmed. A trim system 50, 150, 250 defines an overhang region 56, 156, 256 for receiving a wall panel 24. A trim system 50, 150, 250 further defines a trim height 58, 158, 258 in the overhang region 56, 156, 256. A trim height 58, 158, 258 is sized to correspond to a wall panel 24 and in certain embodiments is larger than a height 36 of a rib, e.g., 34, of a wall panel 24. In other embodiments, a trim height 58, 158, 258 is greater than a thickness of the wall panel 24.

In embodiments, a trim systems 50, 150, 250 may include base trim panels 52, 152, 252 that comprises a base portion 60, 160, 260 having widths 68, 168, 268 respectively, a receiver arms 62, 162, 262, and base arms 64, 164, 264 disposed substantially orthogonal or perpendicular to the base portions 62, 162, 262. The base portion 60, 160, 260 optionally further comprises a plurality of holes spaced along the length of the base trim panel for fasteners 90, such as screws or nails, to pass through and secure the base trim panel to the exterior of the building. To allow for different coefficients of expansion between the building exterior and the trim system, the holes nay be slightly elongated to allow the trim panels to expand or contract independently as the temperature changes. Notably, in various preferred embodiments, a base trim panel and a top trim panel comprise sheet metal. Such embodiments are particularly suitable when a wall panel 24 is formed of sheet metal. In embodiments, a base trim panel and a top trim panel comprise sheet a metal selected to match a sheet metal forming a wall panel 24.

Referring generally to FIGS. 2-7, the trim system 50, 150 in embodiments is advantageously arranged for a single building wall surface, for example wherein the trim system is installed at a window 40 or doorway 42 or edge.

In embodiments shown in FIGS. 2-7, a trim system comprises a base trim panel configured to be mounted to a building surface. A base panel includes a base portion defining a base width along a width dimension from a first base side to a second base side, a receiver portion extending away from the first base side of the base portion, and a base arm extending away from the second base side of the base portion; and a top trim panel configured to be mounted to the base panel after the base panel is mounted to the building surface. A top trim panel may include a front portion defining a front width along the width dimension from a first front side to a second front side, the front width being greater than the base width, a multi-bend arm extending from the first front side of the front portion. A multi-bend arm defines an overhang portion and a retention portion configured to engage the receiver portion of the base trim panel. A multi-bend arm also defines a top arm extending from the second front side of the top trim panel. A top arm at least partially overlaps the base arm, wherein, when installed, the front portion of the top trim panel is spaced apart from the base portion of the base trim panel, and wherein the retention portion of the top trim panel provides snap-in engagement with the receiver portion of the base trim panel.

Referring to FIGS. 2-4, various embodiments of a trim system provide a "raised" trim profile. In these embodiments, a trim system 50 comprises a base trim panel 52 and a top trim panel 54. FIG. 2 shows an exploded view of the trim system 50. FIG. 3 shows a top (cross-section) view of the trim system 50 installed on a building exterior and FIG. 4 shows a front perspective view of the trim system 50 installed on a building exterior. As seen in FIG. 2, a base trim panel 52 comprises a base portion 60 defining a base width 65 along a width dimension from a first base side 61 to a second base side 62, a receiver portion 63 extending away from the first base side 61 of the base portion 60, and a base arm 66 extending away from the second base side 62 of the base portion 60 with height 68. A receiver lip 64 extends laterally from the receiver portion 63 at height 67. Preferably, a receiver portion 63 and the base arm 66 of the base trim panel each extend substantially orthogonally (perpendicularly) away from the base portion 60. In some exemplary embodiments a receiver portion 63 and the base arm 66 extend away from a base portion at angles with respect to a plan of a base portion away from each other, respectively thereby pre-loading a desired interference force with members of top trim panel in an assembled configuration.

An exemplary top trim panel 54 has a front portion 70 defining a front width 76 along the width dimension from a first front side 80 to a second front side 81, the front width 76 being greater than the base width 65 of the base trim panel 52. A multi-bend arm 71 extends from the first front side 80 of the front portion 70, the multi-bend arm 71 defining an overhang portion 72 and a retention portion comprising a first leg 73 and a second leg 74 configured to engage the receiver portion of the base trim panel 52. In embodiments, a retention portion comprises a first leg 73 and a second leg 74 forming an acute angle, as shown in FIG. 2. Notably, in various embodiments, a second leg 74 is resiliently movable relative to a first leg 73 in order to provide snap-in engagement with a receiver portion 63 of a base trim panel 52 and applying an interference fit, e.g., between an edge of second leg 74 and a surface of receiver portion 63. In embodiments a receiver lip 64 extends from an end of receiver portion 63 distal from base portion 60 and in a direction away from a base arm 66. In assembled configurations an edge of second leg 74 engages a surface of receiver lip 64 facing a surface, e.g., building exterior 25, upon which the trim system is mounted to retain a top trim panel 54 to a base trim panel 52. A top trim panel may also comprise a top arm 77 extending from a second front side of the top trim panel 81. In the embodiment shown in FIGS. 2-4, a top trim panel also comprises a spacer portion 75 so that the overhang portion of the multi-bend arm is spaced apart from the front portion of the top trim panel with height 83 that defines the amount the top trim panel is raised above the building panel 24. Distance 84 defines the extent that overhang portion 72 overhangs the panel 24. Although spacer portion 75 is shown to be substantially perpendicular to the front portion 70, this is not limiting.

For installation, as shown in FIGS. 3 and 4, a base trim panel 52 is affixed to a building exterior 25 with fasteners 90, such as staples, brad-nails, trim-nails, screws, or other types of nails. A wall panel 24 is mounted to a building exterior with fasteners such as screws or nails adjacent to the base trim panel. A seam or gap 32 may be formed between the edge 30 of the wall panel 24 and the base trim panel 52. The gap 32 allows room for the retention portion of the top trim panel 54 to engage the receiver portion of the base panel 52. Top trim panel 54 is placed over the base trim panel 52, oriented as in FIG. 2, and then moved toward base trim panel 52 to contact the top panel retention portion with the receiver portion 63 of the base trim panel 52. The receiver portion 63, in particular the receiver lip 64, of the base trim panel is configured to press against the second leg during installation so that as the top trim panel is moved toward the base trim panel, the receiver lip pushes the second leg of the retention portion toward the first leg. When the edge of the second leg clears the receiver lip, the second leg resiliently springs away from the first leg and is trapped by the receiver portion 63 and receiver lip 64. When installed, the top arm and the retention portion of the top trim panel overlap opposite sides of the base trim panel and the overhang portion 72 is configured to cover the edge of the wall panel. As shown in FIG. 3, the panel 24 comprises a ridge 34 at its edge with a height 36. The length of first leg 73 is such that it provides a space 54 that separates the overhang portion from the ridge height 36 and space 58 higher than the retention lip height 67. The top arm 77 preferably is friction-fit to the base arm 66 (see FIG. 3) to help anchor the top trim panel 54 to the base trim panel 52. In the embodiment shown in FIGS. 2-4, the front portion of the top trim panel is configured to extend substantially parallel to the wall panel when installed, but that is not limiting. The ends 80, 81 of the front portion 70 may comprise square corners, rounded corners, clipped corners as shown, beveled corners, or more complex profiles. In other embodiments, the front portion of the top trim panel, optionally including ends 80 and 81 may have a more complex profile to provide a more decorative appearance. In various embodiments, a wall panel or a base trim panel may be fixed to a surface using adhesives, cements, or any suitable fasteners other than screws or nails. In embodiments an adhesive or a sealant may be applied at the interfaces between a trip base panel or a trim top panel to further secure the trim components together or to weatherize the trim.

FIG. 4 shows a front perspective view of a first embodiment of a trim system. In this view, a panel 24 comprises a plurality of ridges 34 that run perpendicular to an edge of panel 24 that faces the trim system 50. In embodiments, a method of installing a trim system in accordance with this disclosure includes mounting a trim base panel to a surface using any suitable means, mounting a wall panel 24 leaving a gap between a base panel edge or surface and wall panel 24, painting the visible surfaces of the trim base and the wall panel, including, e.g., a surface of a receiver portion, then attaching a top trim panel to a base trim panel such that a top trim panel and a base trim panel are secured together via at least a snap-on fit or an interference fit. In embodiments, a top panel portion may be painted before securing it to a base panel portion, including applying paint to any visible surfaces including, e.g., a surface of a first leg 73.

FIGS. 5-7 show various alternative embodiments wherein a trim system 150 provides a "flush" appearance. It is similar to a trim system 50 shown in FIGS. 2-4 except that it does not include a spacer portion so that an overhang portion of a multi-bend arm is not spaced apart from the front portion of a top trim panel.

FIG. 5 shows an exploded view of various embodiments of trim system 150. FIG. 6 shows a top end (cross-section) view of exemplary trim system 150 installed on a building exterior and FIG. 7 shows a front perspective view of exemplary trim system 150 installed on a building exterior. As seen in FIG. 5, a base trim panel 152 comprises a base portion 160 defining a base width along a width dimension from a first base side to a second base side, a receiver portion 163 extending away from the first base side of the base portion 160, and a base arm 166 extending away from the second base side of the base portion 60. A receiver lip 164 extends laterally from the receiver portion 163. Preferably, the receiver portion 163 and the base arm 166 of the base trim panel 152 each extend substantially orthogonally (perpendicularly) away from the base portion 160.

It will be appreciated that in some embodiments, embodiments of a trim system 150 may have a same base trim panel 152 as exemplary base trim panel 52 of exemplary trim system 50.

A top trim panel 154 comprises a front portion 170 defining a front width 176 along the width dimension from a first front side 180 to a second front side 181, the front width 176 being greater than the base width 165 of the base trim panel 152. A multi-bend arm 171 extends from the first front side 180 of the front portion 170, the multi-bend arm 171 defining an overhang portion 172, and a retention portion comprising a first leg 173 and a second leg 174 configured to engage the receiver portion 163 of the base trim panel 152. In embodiments, a retention portion comprises a first leg 73 and a second leg 74 forming an acute angle, as shown in FIG. 5. Notably, a second leg 174 is resiliently movable relative to the first leg 173 to provide snap-in engagement with the receiver portion 163 of the base trim panel 152. Upon reading this entire disclosure, one will appreciate that an amount of resilience impact the amount of force is required to secure a top trim panel to a base trim panel. An exemplary top trim panel also comprises a top arm 177 extending from the second front side or edge 181 of the top trim panel 154. In embodiments shown in FIGS. 5-7, an overhang portion 172 of the multi-bend arm 171 is not spaced apart from the front portion 170 but instead is bent or folded under the front portion 170 so that surfaces of the overhang portion 172 and the front portion 170 are adjacent to each other. In other words, in various embodiments an overhang portion of multi-bend arm is substantially flush with a front portion of a top trim panel. Distance 184 defines the extent that overhang portion 172 overhang s the panel 24.

In embodiments, a receiver lip, e.g., 164, of a receiver portion, e.g., 163 and a first leg, e.g., 174, of the retention portion are acutely angled relative to the building surface such that in an assembled condition a receiver lip 164 extends in part to wards a mounting surface such that receiver lip hooks over and in part overlaps a portion of a first leg in a direction perpendicular to a receiver portion.

Installation of the trim system 150 on a building exterior is similar to that described above for trim system 50. As shown in FIGS. 6 and 7, the base trim panel 152 and wall panel 24 are affixed to the building exterior 20 with fasteners 90, such as screws or nails or by any suitable means such that a seam or gap is formed between the edge of the wall panel 24 and the base trim panel 152. A gap allows room for a retention portion of the top trim panel 154 to engage a receiver portion of the base panel 152. Top trim panel 154 is placed over the base trim panel 152, oriented as in FIG. 5, and then moved toward base trim panel 152 to contact the receiver portion 163, where the receiver lip 164 pushes the second leg 174 toward the first leg 173 of the retention portion. In embodiments an installer may slap or strike (with an appropriate mallet that does not damage or dent) a surface of, e.g., front portion 170 in order to cause engagement a top trim plate to a base trim plate. When an edge of the second leg 174 clears a receiver lip 164, the second leg 174 resiliently springs away from the first leg 173 and is trapped by the receiver portion 163 and receiver lip 164. When installed, the overhang portion 172 is configured to cover the edge of the wall panel 24. This snap op securement may further cause an interference fit between, e.g., top arm 177 and base arm 166 and also cause an interference fit between, e.g., an edge of second leg 174 and receiver portion 163.

Notably, in the trim systems 50 and 150, when installed, the receiver lip 64, 164 of the receiver portion 63, 164 is substantially parallel to the building surface and the first leg 73, 174 of the retention portion of the top trim panel 54, 154 is substantially orthogonal relative to the building surface.

The trim systems 50 and 150 can be conveniently manufactured by folding or bending sheets of metal, or other materials. Base trim panels 52, 152 can be made from a first sheet having a first side and a second side on opposite lateral sides of a base portion 60, 160, the method comprising forming a receiver portion 63, 163 by bending the first side substantially orthogonally away from the base portion 60, 160 in a first direction and forming a receiver lip 64, 164 on the receiver portion 63, 163 by bending an end of the receiver portion 63, 163 laterally away from the base portion 60. A base arm 66, 166 is formed by bending the second side substantially orthogonally away from the base portion 60, 160 in the first direction wherein the receiver portion and the base arm define a width 65, 165 of the base portion.

In embodiments, a method of installing a trim system, e.g., 150 in accordance with this disclosure includes mounting a trim base panel to a surface using any suitable means, mounting a wall panel 24 leaving a gap between a base panel edge or surface and wall panel 24, painting the visible surfaces of the trim base and the wall panel, including, e.g., a surface of a receiver portion, then attaching a top trim panel to a base trim panel such that a top trim panel and a base trim panel are secured together via at least a snap-on fit or an interference fit. In embodiments, a top panel portion may be painted before securing it to a base panel portion, including applying paint to any visible surfaces including, e.g., a surface of a first leg 173.

The top trim panels 54, 154 can be formed from a second sheet having a first side and a second side on opposite sides of a central portion, forming a multi-bend arm 71, 171, defining an overhang portion 72, 172, and a retention portion configured to engage the receiver portion 63, 163 of the base trim panel 52, 152 by bending the first side to form a multi-bend arm, comprising bending a first portion of the multi-bend arm back over the central portion in a first direction to form the overhang portion 72, 172 extending substantially parallel to the central portion. A second portion of the multi-bend arm extending from the first portion is bent orthogonally away from the central portion in the first direction to form a first leg of a retention portion, and a third portion extending from the first leg is bent back toward the first leg to provide a second leg of the retention portion wherein the first leg and the second leg form an acute angle. A top arm is formed by bending the second side substantially orthogonally away from the central portion in the first direction.

In the embodiment shown in FIGS. 2-4, forming the top trim panel 50 further comprises forming a spacer portion between the central portion and the overhang portion by forming a first bend between the spacer portion and the central portion by bending in a direction away from the central portion, and forming a second bend between the spacer portion and the retention portion by bending in a direction toward the central portion.

Notably, when assembled, a base portion of a base trim panel is configured to be affixed to a surface of a building, and the central portion and the overhang portion of the top trim panel comprises a front portion of the trim panel assembly with a width greater than the width of the base portion.

Figure 9:
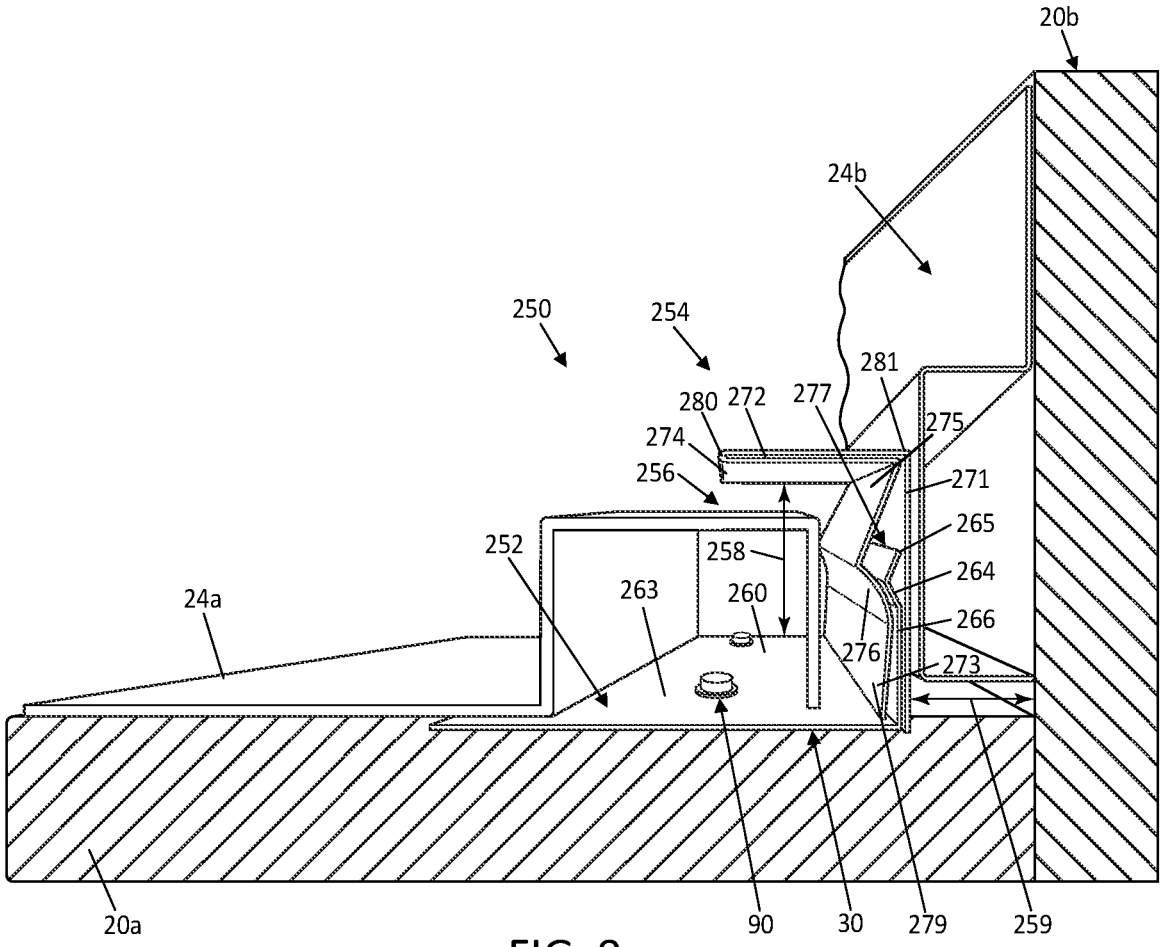
FIG. 9 is a top end view of various embodiments of a trim system in accordance with FIG. 8 assembled on a portion of a building.
Figure 10:
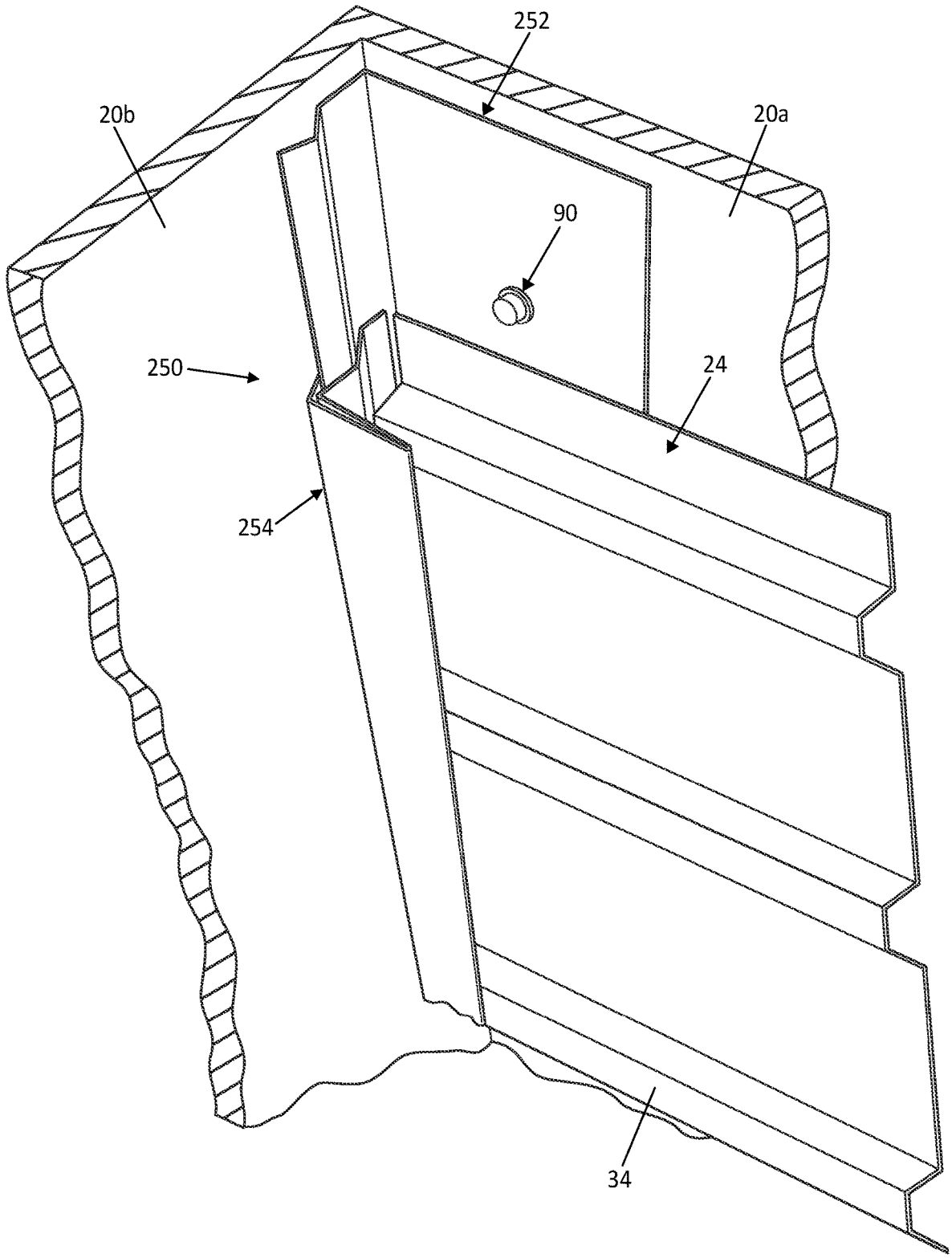
FIG. 10 is a partial front perspective view of various embodiments of a trim system in accordance with FIG. 8 assembled on a portion of a building.

Referring to FIGS. 8-10, various embodiment of a trim system 250 are illustrated which may also be applicable to a building exterior (FIG. 1), such as an interior or inner corner 46 of a building exterior, such as an interior corner formed by building exteriors 20*a* and 20*b* in FIG. 9. FIG. 8 is an exploded perspective view of trim system 250, FIG. 9 is a top end view of the trim system 250 assembled on a portion of a building, and FIG. 10 is a partial front perspective view of the trim system 250 assembled on a portion of a building.

Trim system 250 comprises a base trim panel. Exemplary base trim panels include a base portion configured to be mounted to a building surface. Exemplary base trim panels further include a receiver arm extending substantially orthogonally away from a first side of a base portion comprising a receiver portion at a distal end thereof. Exemplary receiver portions provide a convexly shaped surface feature configured to engage a retention portion of a top trim panel. An exemplary top trim panel includes an outer portion comprising a first outer leg and a second outer leg disposed substantially perpendicular to the first outer leg, an inner portion comprising a first inner leg comprising and a second inner leg. An exemplary first inner leg has a proximal portion and a distal portion and a retention portion formed between the proximal portion and the distal portion defining a concave pocket between the first outer leg and the first inner leg for engagement with a receiver portion of a base trim panel. A second inner leg extends from a second outer leg and is substantially adjacent and parallel to the second outer leg. In various embodiments of a trim system 250 a proximal end of a first inner leg is angled away from the first outer leg and distal end of the first inner leg is disposed adjacent to and substantially parallel to the first outer leg. In various embodiments of the trim system 250, a base trim panel is mounted to a first building surface and a receiver arm is configured to extend parallel to a second building surface perpendicular to the first building surface. It will also be appreciated that a second building surface may be a window sill, a door frame, or any other interruption of a mounting surface rather than a separate wall.

Trim system 250, useful for single-wall surfaces, such as first or second exterior building surfaces, or a corner of first and second exterior building surfaces, among other surface features, includes a base trim panel 252 comprising a base portion 260 configured to be mounted to a first building surface, and a receiver arm 262 extending substantially orthogonally away from a first side of the base portion 260. In a corner of first and second exterior building surfaces, receiver arm 262 is configured to extend parallel to a second building surface perpendicular to the first building surface. An exemplary receiver arm 262 comprises a receiver portion 263 comprising flange 264 and receiver lip 265 at a distal end thereof. Flange 264 and lip 265 individually or together form a bent or folded portion to provide a convex surface configured to engage a retention portion of a top trim panel. In this embodiment, the base trim panel 252 is generally L-shaped. In an optional variant of this embodiment, the side opposite the receiver arm 262 can be bent or folded over the base portion 260 to provide flap 266, disposed adjacent to base portion 260. In embodiments a receiver arm may include multiple bends or folds, a portion having an enlarged cross-sectional profile in the form of a retaining lip. In embodiments, a receiver arm may also be formed to fold over on itself to form an expanded cross section to form a receiver portion.

Trim system 250 also comprises a generally L-shaped top trim panel 254 configured to be mounted to the base trim panel 252 after the base trim panel 252 is mounted to the first building surface. The top trim panel 254 comprises an L-shaped outer portion comprising a first outer leg 271 and a second outer leg 272 divided by edge 281. The top trim panel 254 also comprises a generally L-shaped inner portion comprising a first inner leg 273 and a second inner leg 274, wherein the second inner leg 274 extends from the second outer leg 272 at edge 280 and is substantially adjacent to the second outer leg 272. The first inner leg 273 comprises a proximal portion 275 and a distal portion 279, wherein the first inner leg 273 is concavely bent between the proximal portion 275 and the distal portion 279. The proximal portion 275 is angled away from the first outer leg 271 and a concave bending 276 defines a retention portion or pocket 277 between the first outer leg 271 and the first inner leg 273 for engagement with a receiver portion 263, e.g., a receiver lip 265, of a base trim panel 252. Distal portion 279 is disposed proximate to the first outer leg 271, where it is angled away from first outer leg so that a space is defined between an end of distal portion and a first out leg to allow a receiver portion 263, e.g., a receiver lip 265 and flange 264, to pass between distal portion 279 and first outer leg 271 into a retention portion 277. Retention portion 277 of a top trim panel 254 provides snap-in engagement with the receiver portion 263 of the base trim panel 252. In embodiments, a receiver portion 263 further engages surfaces defining retention portion 277 by an interference fit further securing a base trim panel 252 to a top trim panel 254. Notably, in various desirable embodiments an inner portion of the top trim panel 254 is integrally formed with the outer portion from a single sheet bent or folded over itself. Edge 281 may be square, rounded, curved, beveled or take any desirable shape.

As shown in FIG. 9, a base trim panel 252 is installed on a first building exterior 20*a* with fasteners 90 such that base arm 266 extends orthogonally from first building exterior 20*a*. In a corner of first and second exterior building surfaces, base arm 266 is disposed parallel to a second building exterior 20*b*. A base trim panel 252 is generally L-shaped and a top trim panel 254 is generally L-shaped so that, when assembled, the trim system is 250 generally C-shaped with a wall panel 24*a* (shown as transparent for ease of presentation) extending into the open end of the C-shape. When a retention portion 277 of a top trim panel 254 is engaged with a receiver portion of a base trim panel, a second outer leg 272 and a second inner leg 274 of a top trim panel 252 are spaced from a base portion of a base trim panel at height 258 and define an overhang region 256. Height 258 is sufficient to allow wall panel 24*a* to be disposed between a base portion 260 of a base trim panel 252 and an overhang region 256 of a top trim panel 254.

For installation, as shown in FIGS. 9 and 10, the base trim panel 252 is mounted to the building exterior 25 with fasteners 90, such as screws or nails. A wall panel 24*a* is mounted to the building exterior with fasteners such as screws or nails adjacent to and overlaying the base trim panel wherein the edge 30 of the wall panel 24*a* is disposed extending into the overhang region 256 between base trim panel 252 and top trim panel 254. Top trim panel 254 is placed over the base trim panel 252, oriented as in FIG. 8, and then moved toward base trim panel 252 to contact the distal portion 279 of top trim panel 254 with the receiver portion 263 of the base trim panel 252. The receiver portion 263, in particular the receiver lip 265, of the base trim panel 252 is configured to press against the distal portion 279 during installation so that as the top trim panel 254 is moved toward the base trim panel 252, the receiver lip 265 pushes between the distal portion 279 and first outer leg 271, widening the separation between the first out leg 271 and the first inner leg 273. When the receiver lip 265 and flange 264 are within the concave pocket 277 of retention portion 277, the distal end of the first inner leg 273 resiliently springs toward the first outer leg 271, thereby trapping the receiver portion 263 within the retention portion 277 and trapping the receiver arm 262 between the distal portion 279 and the first outer leg 271.

As shown with reference to FIG. 9, in a corner of first and second exterior building surfaces, a base trim panel 252 may be, but need not be, installed spaced apart from a second building exterior 20*b* so that when the top trim panel 254 is installed a space 259 is defined between first leg 271 and the second building exterior 20*b*. Space 259 is sufficient to allow a second building panel 24*b* to be installed between the trim system 250 and the second building exterior 20*b*. In this way, trim system 250 can cover the edges of both panels 24*a* and 24*b*. As shown with reference to FIG. 10, in a corner of first and second exterior building surfaces, the base trim panel 252 is attached to building surface 20*a* to minimize the space between it and the building exterior 20*b* so that when installed, the first outer leg 271 is disposed adjacent to building exterior 20*b*. This mode of installation may be particularly useful when building exterior 20*b* comprises, for example, doorway or window trim where a building panel 24*b* is not needed.

The exemplary embodiment of trim system 250 shown in FIGS. 8-10 illustrates that a receiver portion 263 of a base trim panel 252 may include planar components, flange 364 and receiver lip 365 formed with folds, and a retention portion 277 of a top trim panel 254 may include planar components formed with folds defining a concave pocket 277; however, this is not limiting. In an alternative embodiment (not shown) the receiver portion 263 and the retention portion may be formed as other suitable complementary curved segments.

In another alternate embodiment of trim system 250 (not shown), the second outer leg 272 and the second inner leg 274 may be separated by a spacer portion analogous to spacer portion 75 of trim system 50, so that a second outer leg 272 and the second inner leg 274 are separated by a distance analogous to height 83 of FIG. 2, to provide a "raised" trim appearance.

The trim panel system 250 can be manufactured by forming a base trim panel 252 configured to be mounted to a building surface, comprising providing a first sheet having a first portion and a second portion disposed across the width of the first sheet, forming a receiver portion by bending the first portion substantially orthogonally away from the second portion in a first direction, to define an L-shaped base trim panel 252 wherein the second portion defines a base width of the base trim panel 252; and forming a receiver lip on the receiver portion by bending an end of the receiver portion laterally away from the first portion.

The top trim panel 254 comprises an inner portion and an outer portion wherein the inner portion may be integrally formed with the outer portion from a second sheet bent or folded over itself. The outer portion and the inner portion are both generally L-shaped, and the inner portion is nested within the outer portion. Making the top trim panel includes providing a second sheet having a first portion, a second portion, a third portion and a fourth portion disposed across the width of the second sheet, bending the first portion in a first direction to be perpendicular to the second portion to define an outer portion comprising a first outer leg and a second outer leg. The fourth portion is bent in a direction opposite the first direction to provide a first inner leg extending from the third portion, the first inner leg comprising a proximal portion and a distal portion, and the sheet between the proximal portion and the distal portion is bent to provide a concave retention portion configured for engagement with the receiver lip of the base trim panel. The third portion is bent back upon the second portion to provide a second inner leg extending from the end of the second outer leg and disposed substantially parallel to the second outer leg and disposing the distal portion of the first inner leg to be proximate to the first outer leg.

Optionally, a method may further comprise bending the second side of the base trim panel back over at least part of the base portion of the base trim panel to form flap 266 as shown in FIG. 8.

For installation on a building surface 20, the trim systems 50, 150, 250 provide a simplified and time-reducing method. Installation of the two-part trim systems disclosed herein allows for mounting of the base trim panel using fasteners through the base portions without interference from the top trim panel, which is installed later. The building panels can be installed on the building by laying up the panels with their edges disposed adjacent to or overlaying the base portion of the base trim panels and fastening the panels to the building exterior. Because the top trim panel is not attached to the base trim panel, the panels do not need to be manipulated or trimmed to fit within the trim systems. The top trim panels can be easily snap-fit onto the base panels to cover the edges of the panels after they are installed.

The trim systems provide for installation of the building panel and the top trim panel without any cuts to either piece for size range variations of about 0 to 4 inches for the rigid building panel although other dimensions are possible as one will appreciate upon a full reading of this disclosure.

In embodiments, a trim system includes a steel snap-on J-channel system comprising a receiving panel and a snap-on panel. A receiving panel formed of steel mounts to a surface to be covered with steel siding. Non-limiting examples of a receiving panel are steel formed base trim panel 52, 152, 252. A receiving panel is attached to the surface to be covered with steel siding, steel siding is attached to the surface, e.g., a steel formed panel 24. A snap-on panel formed of steel is then fixedly mounted to the receiving panel such that from a view away from the surface, at least a portion of the snap-on panel overlaps the surface such that the surface is not visible, e.g., through cracks or seems at an end of a steel panel. Non-limiting examples of a snap-on panel are steel formed base trim panel 54, 154, 254. A snap-on panel may be fixedly attached to a receiving portion via an engagement, an interference fit, or a locking fit between the snap-on panel and the receiving panel. Examples of engagements between a snap-on panel and a receiving panel are shown in at least FIGS. 4, 6 and 9. For example, FIGS. 4, 6 illustrate an exemplary locking fit between as steel second leg 174 and a steel receiving lip 164. FIGS. 4, 6 also show an interference fit between opposing surfaces of a steel base arm, e.g., base arm 66 or base arm 166, and a steel top arm, e.g., top arm 77 or top arm 177 and FIG. 9 illustrates an exemplary interference fit between a steel receiver arm, e.g., flange 264 having a lip 265, and a steel snap-on arm, e.g., an arm formed of first outer leg 271 and first inner leg 273 configured, e.g., to form a retention portion or pocket 277.

In embodiments, adhesive may be utilized. For example, upon a full reading of this disclosure one will appreciate that adhesive may be used to reinforce an attachment between a steel receiving panel and a steel snap-on panel, but that in many embodiments such an adhesive is not necessary or desirable (e.g., because omitting adhesives simplifies manufacture or installation).

As discussed above, when painting a building exterior with traditional J-channels it is difficult to paint inside the J-channels so that unpainted areas may be visible. The trim systems disclosed herein provide ways to avoid unpainted areas that are visible from outside the building.

In embodiments, surfaces of the base trim panel and the top trim panel not contacting the building exterior after installation are uniformly treated with an appearance coating. Appearance coatings may include powder coatings, paints, protective clearcoats, patina-forming coatings, textured coatings, etc. In various embodiments, textured paints are used that obscure or eliminate oil canning effects on steel sheet metal.

In some embodiments, the base trim panel and the top trim panel may be powder coated during the manufacturing process. Powder coating at this time may provide more durable finishes than other appearance coatings. In embodiments, building panels may also be powder coated similar to the trim panels to provide a complete system for cladding the exterior of a building comprising a substantially rigid building panel configured to be mounted to a building surface, the building panel defining an edge; wherein the top trim panel is configured to be mounted to the base panel after the building panel and the base panel are mounted to the building surface wherein a seam or gap is formed between the edge of the building panel and the base trim panel; and the overhang portion is configured to cover the edge of the building panel. One can appreciate that to clad an entire building, installation of pluralities of building panels, base trim panels and top trim panels would be required. An installer may order from a manufacturer combinations of panels and trim systems as needed to clad a building with uniform appearance. Building panels and trim panels may be selected from a variety of predetermined sizes and finishes to provide a uniform appearance while also minimizing the amount of cuts needed.

In other embodiments, applying an appearance coating may occur at the time of installation on a building. In these embodiments, the building panels and the base trim panels are installed on the exterior and then coated, such as by spray-painting, before the top trim panel is installed. This allows application of the appearance coating on all surfaces that would be covered by the top trim panel after it is snap-fitted to the base trim panel. The top trim panel may be coated (spray-painted) before its installation on the base trim panel. Alternatively, the building panel and the base trim panel may be coated, the top trim panel installed and then the top trim panel is coated after its installation.

Various modifications to the above examples and embodiments are contemplated to be within the scope of the present disclosure. The various portions of the base trim panel 52, 152, 252 and the top trim panel 54, 154, 254 may be adjusted in size, angle, material, or the like. The building panels 24 and the trim systems 50, 150, 250 may be formed of various known materials or combinations of materials that are metallic (e.g., steel, copper, aluminum or alloys) or non-metallic (e.g., vinyl, fiber cement board, composites).

One aspect of this disclosure provides a trim system for an exterior wall or ceiling, comprising a base trim panel configured to be mounted to a building surface, the base panel comprising a base portion defining a base width along a width dimension from a first base side to a second base side, a receiver portion extending away from the first base side of the base portion, and a base arm extending away from the second base side of the base portion; and a top trim panel configured to be mounted to the base panel after the base panel is mounted to the building surface, the top trim panel comprising a front portion defining a front width along the width dimension from a first front side to a second front side, the front width being greater than the base width, a multi-bend arm extending from the first front side of the front portion, the multi-bend arm defining an overhang portion, and a retention portion configured to engage the receiver portion of the base trim panel, and a top arm extending from the second front side of the top trim panel, the top arm at least partially overlapping the base arm, wherein, when installed, the overhang portion of the top trim panel is spaced from the base portion of the base trim panel, and wherein the retention portion of the top trim panel provides snap-in engagement with the receiver portion of the base trim panel.

Embodiments of the trim system described above include the following, alone or in any combination.

The trim system wherein the top trim panel is configured to be mounted to the base trim panel after a substantially rigid building panel is mounted to a building surface adjacent to the base trim panel, the building panel defining an edge, wherein a seam or gap is formed between the edge of the building panel and the base trim panel; and the overhang portion is configured to cover the edge of the building panel.

The trim system further comprising a substantially rigid building panel configured to be mounted to a building surface, the building panel defining an edge; wherein the top trim panel is configured to be mounted to the base panel after the building panel and the base panel are mounted to the building surface wherein a seam or gap is formed between the edge of the building panel and the base trim panel; and the overhang portion is configured to cover the edge of the building panel.

The trim system wherein the overhang portion of the top trim panel, when installed, extends laterally beyond the base trim panel.

The trim system wherein the retention portion comprises a first leg and a second leg forming an acute angle.

The trim system wherein the second leg is resiliently movable relative to the first leg.

The trim system wherein the receiver portion of the base trim panel is configured to press against the second leg during installation.

The trim system wherein the top arm and the retention portion of the top trim panel overlap opposite sides of the base trim panel.

The trim system wherein the front portion of the top trim panel is configured to extend substantially parallel to the building panel when installed.

The trim system wherein the receiver portion and the base arm of the base trim panel each extend substantially orthogonally away from the base portion.

The trim system wherein the receiver portion of the base trim panel comprises a receiver lip extending laterally from the receiver portion to engage an edge of the second leg of the top trim panel.

The trim system wherein the top trim panel is not fastened to the base trim panel.

The trim system wherein the base trim panel and the top trim panel comprise sheet metal.

The trim system wherein, when installed, the receiver lip of the receiver portion is substantially parallel to the building surface and the first leg of the retention portion is substantially orthogonal relative to the building surface.

The trim system wherein the overhang portion of the multi-bend arm is spaced apart from the front portion of the top trim panel.

The trim system wherein the overhang portion of the multi-bend arm is substantially adjacent to the front portion of the top trim panel.

Also disclosed is a method of manufacturing a trim panel system for a building exterior as described above, comprising forming a base trim panel configured to be mounted to a building surface, comprising providing a first sheet having a first side and a second side on opposite lateral sides of a base portion, forming a receiver portion by bending the first side substantially orthogonally away from the base portion in a first direction, forming a receiver lip on the receiver portion by bending an end of the receiver portion laterally away from the base portion, and forming a base arm by bending the second side substantially orthogonally away from the base portion in the first direction wherein the receiver portion and the base arm define a width of the base portion; and forming a top trim panel, comprising providing a second sheet having a first side and a second side on opposite lateral sides of a central portion, forming a multi-bend arm defining an overhang portion and a retention portion configured to engage the receiver portion of the base trim panel by bending the first side, wherein bending the first side comprises bending a first portion of the multi-bend arm back over the central portion to form an overhang portion extending substantially parallel to the central portion, bending a second portion of the multi-bend arm extending from the first portion substantially orthogonally away from the central portion to form a first leg of a retention portion and bending a third portion extending from the first leg back toward the first leg to provide a second leg of the retention portion wherein the first leg and the second leg form an acute angle, and forming a top arm by bending the second side substantially orthogonally away from the central portion, wherein the central portion and the overhang portion of the top trim panel comprises a front portion of the trim panel assembly with a width greater than the width of the base portion.

Embodiments of the method include the method further comprising forming a spacer portion between the central portion and the overhang portion by forming a first bend between the spacer portion and the central portion by bending in a direction away from the central portion, and forming a second bend between the spacer portion and the retention portion by bending in a direction toward the central portion.

Also disclosed is a method of installing the trim system described above, for a building exterior having a substantially rigid building panel mounted to the building exterior, the building panel defining an edge, comprising mounting the base trim panel to the building exterior; installing the building panel to the building exterior with the edge adjacent to the base trim panel, wherein a seam or gap is formed between the building panel and the base trim panel; and snap-fitting the top trim panel to the base trim panel, wherein the front portion and the overhang portion of the top trim panel cover the seam or gap.

Embodiments of the method include the following, alone or in any combination.

The method wherein the base trim panel is installed before the building panel is mounted to the building exterior.

The method wherein the base trim panel is installed after the building panel is mounted to the building exterior.

The method wherein surfaces of the base trim panel and the top trim panel not contacting the building exterior after installation are uniformly treated with an appearance coating.

Also provided is a trim system comprising a base trim panel comprising a base portion configured to be mounted to a building surface, and a receiver arm extending substantially orthogonally away from a first side of the base portion comprising a receiver portion at a distal end thereof, wherein the receiver portion provides a convex surface configured to engage a retention portion of a top trim panel, and a top trim panel comprising an outer portion comprising a first outer leg and a second outer leg disposed substantially perpendicular to the first outer leg; and an inner portion comprising a first inner leg comprising and a second inner leg; wherein the first inner leg comprises a proximal portion and a distal portion and a retention portion formed between the proximal portion and the distal portion defining a concave pocket between the first outer leg and the first inner leg for engagement with the receiver portion of the base trim panel; wherein the second inner leg extends from the second outer leg and is substantially adjacent to and parallel to the second outer leg and defines an overhang portion.

Embodiments of the trim system include the following, alone or in any combination.

The trim system wherein the proximal end of the first inner leg is angled away from the first outer leg and distal end of the first inner leg is proximate to the first outer leg.

The trim system wherein the top trim panel is configured to be engaged with the base panel after a substantially rigid building panel defining an edge is mounted to a building surface, wherein when the building panel is mounted to the building surface with the edge adjacent to or overlaying the base trim panel, the overhang portion is configured to overhang the edge of the building panel.

The trim system further comprising a substantially rigid building panel configured to be mounted to a building surface, the building panel defining an edge; wherein the top trim panel is configured to be engaged to the base panel after the base panel and the building panel are mounted to the building surface wherein when the edge of the building panel is mounted adjacent to or overlaying the trim base panel the overhang portion is configured to overhang the edge of the building panel.

The trim system wherein the base trim panel and the top trim panel are both generally L-shaped and, when the retention portion of the top trim panel is engaged with the receiver portion of the base trim panel, the trim system is generally C-shaped and configured to receive a building panel defining an edge extending into the open end of the C-shape.

The trim system wherein, when installed, the first inner leg and the first outer leg of the top trim panel overlap with the receiver portion of the base trim panel.

The trim system wherein the retention portion and the receiver portion comprise complementary curves.

The trim system wherein the receiver portion, the receiver arm, the retention portion, the first inner leg and the first outer leg cooperate to create an interference fit when assembled, thereby retaining the top trim panel to the base trim panel.

The trim system wherein the base trim panel is mounted to a first building surface so that the receiver arm is disposed parallel to a second building surface.

The trim system wherein the receiver portion of the base trim panel is not fastened to the second building surface.

Also provided is a method of installing the trim system described above, for a building exterior having a substantially rigid building panel mounted to the building exterior, the building panel defining an edge, the method comprising mounting the base trim panel to a first surface of a building exterior wherein the receiver portion extends substantially orthogonally away from a first side of the base extends substantially parallel to a second building surface perpendicular to the first building surface; installing the building panel to the building exterior with the edge adjacent to or overlaying the base portion of the base trim panel; and snap fitting the top trim panel to the base trim panel; wherein the second outer leg and the second inner leg overhang the edge of the building panel.

Embodiments of the method include the following, alone or in any combination.

The method wherein the base trim panel is mounted to the first surface of a building exterior so that the receiver portion of the base trim panel is spaced apart from the second building surface to define a space between the receiver portion and the second building surface to allow a second building panel to be inserted into the space.

The method wherein the base trim panel is mounted to the first surface of a building exterior so that when the top trim panel is snap fitted to the receiver portion of the base trim panel the first outer leg is substantially adjacent to the second building surface.

The method wherein surfaces of the base trim panel and the top trim panel not contacting the building exterior after installation are uniformly treated with an appearance coating.

All of the features disclosed, claimed, and incorporated by reference herein, and all of the steps of any method or process so disclosed, may be combined in any combination, except combinations where at least some of such features and/or steps are mutually exclusive. Each feature disclosed in this specification may be replaced by alternative features serving the same, equivalent or similar purpose, unless expressly stated otherwise. Thus, unless expressly stated otherwise, each feature disclosed is an example only of a generic series of equivalent or similar features. Inventive aspects of this disclosure are not restricted to the details of the foregoing embodiments, but rather extend to any novel embodiment, or any novel combination of embodiments, of the features presented in this disclosure, and to any novel embodiment, or any novel combination of embodiments, of the steps of any method or process so disclosed.

The above summary of the various representative embodiments of the invention is not intended to describe each illustrated embodiment or every implementation of the invention. Rather, the embodiments are chosen and described so that others skilled in the art can appreciate and understand the principles and practices of the invention. The Figures in the detailed description more particularly exemplify these embodiments.

Although specific examples have been illustrated and described herein, it will be appreciated by those of ordinary skill in the art that any arrangement calculated to achieve the same purpose could be substituted for the specific examples disclosed. This application is intended to cover adaptations or variations of the present subject matter. Therefore, it is intended that the invention be defined by the attached claims and their legal equivalents, as well as the illustrative aspects. The above-described embodiments are merely descriptive of its principles and are not to be considered limiting. Further modifications of the invention herein disclosed will occur to those skilled in the respective arts and all such modifications are deemed to be within the scope of the inventive aspects.

What is claimed is:

1. A trim system comprising:

a base trim panel comprising a base portion configured to be mounted to a building surface, and a receiver arm extending substantially orthogonally away from a first side of the base portion comprising a receiver portion at a distal end thereof, wherein the receiver portion provides a convex surface configured to engage a retention portion of a top trim panel, and the top trim panel comprising an outer portion comprising a first outer leg and a second outer leg disposed substantially perpendicular to the first outer leg;

and an inner portion comprising a first inner leg and a second inner leg;

wherein the first inner leg comprises a proximal portion and a distal portion and a retention portion formed between the proximal portion and the distal portion defining a concave pocket between the first outer leg and the first inner leg for engagement with the receiver portion of the base trim panel;

wherein the second inner leg extends from the second outer leg and is substantially adjacent to and parallel to the second outer leg and defines an overhang portion.

2. The trim system of claim 1, wherein the proximal end of the first inner leg is angled away from the first outer leg, and the distal end of the first inner leg is proximate to the first outer leg.

3. The trim system of claim 1, wherein the base trim panel and the top trim panel are both generally L-shaped and, when the retention portion of the top trim panel is engaged with the receiver portion of the base trim panel, the trim system is generally C-shaped and configured to receive a building panel defining an edge extending into an open end of the C-shape.

4. The trim system of claim 1, wherein the base trim panel is configured to be mounted to a first building surface so that the receiver arm is disposed parallel to a second building surface.

5. A method of manufacturing a trim panel system for a building exterior according to claim 1, comprising:

forming a base trim panel configured to be mounted to a building surface, comprising providing a first sheet comprising a first portion and a second portion disposed across a width of the first sheet, forming a receiver portion by bending the first portion substantially orthogonally away from the second portion in a first direction, wherein the second portion defines a base width of the base trim panel; and forming a receiver lip on the receiver portion by bending an end of the receiver portion laterally away from the first portion; and forming a top trim panel configured to be mounted to the base trim panel after the base trim panel is mounted to the building surface comprising:

providing a second sheet comprising a first portion, a second portion, a third portion and a fourth portion disposed across the width of the second sheet;

bending the first portion in a first direction to be perpendicular to the second portion to define an outer portion comprising a first outer leg and a second outer leg;

bending the fourth portion in a direction opposite the first direction to provide a first inner leg extending from the third portion, the first inner leg comprising a proximal portion and a distal portion;

bending the sheet between the proximal portion and the distal portion to provide a concave retention portion configured for engagement with the receiver lip of the base trim panel;

bending the third portion back upon the second portion to provide a second inner leg extending from the end of the second outer leg and disposed proximate to the second outer leg; and disposing the distal portion of first inner leg to be proximate to the first outer leg.

6. The method of claim 5, further comprising bending the second side of the base trim panel back over at least part of the base portion of the base trim panel.

7. A method of installing the trim system of claim 1, for a building exterior having a substantially rigid building panel mounted to the building exterior, the building panel defining an edge, the method comprising:

mounting the base trim panel to a first surface of a building exterior wherein the receiver portion extends substantially orthogonally away from a first side of the base extends substantially parallel to a second building surface perpendicular to the first building surface;

installing the building panel to the building exterior with the edge adjacent to or overlaying the base portion of the base trim panel; and snap fitting the top trim panel to the base trim panel;

wherein the second outer leg and the second inner leg overhang the edge of the building panel.

8. The method of claim 7, wherein the base trim panel is mounted to the first surface of a building exterior so that when the top trim panel is snap fitted to the receiver portion of the base trim panel the first outer leg is substantially adjacent to the second building surface.

* * * * *